US010920954B2

(12) United States Patent
Floc'h

(10) Patent No.: US 10,920,954 B2
(45) **Date of Patent: *Feb. 16, 2021**

(54) OPTICAL DEVICE FOR A LIGHTING AND/OR SIGNALLING DEVICE OF AN AUTOMOBILE VEHICLE

(71) Applicant: Valeo North America, Inc., Troy, MI (US)

(72) Inventor: Lionel Floc'h, Seymour, IN (US)

(73) Assignee: Valeo North America, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/808,995

(22) Filed: Mar. 4, 2020

(65) Prior Publication Data

US 2020/0400284 A1 Dec. 24, 2020

Related U.S. Application Data

(63) Continuation of application No. 16/447,396, filed on Jun. 20, 2019, now Pat. No. 10,648,637.

(51) Int. Cl.

| | |
|---|---|
| ***F21S 43/241*** | (2018.01) |
| ***F21S 43/249*** | (2018.01) |
| ***F21S 43/14*** | (2018.01) |
| ***F21S 43/20*** | (2018.01) |
| ***F21S 43/40*** | (2018.01) |

(52) U.S. Cl.

CPC ..... *F21S 43/241* (2018.01); *F21S 43/14* (2018.01); *F21S 43/249* (2018.01); *F21S 43/26* (2018.01); *F21S 43/40* (2018.01)

(58) Field of Classification Search

CPC ..... F21S 43/241; F21S 43/249; F21S 43/40; F21S 43/14; F21S 43/26

See application file for complete search history.

(56) References Cited

U.S. PATENT DOCUMENTS 10,363,860 B2 * 7/2019 Suwa ..... F21S 41/663
10,429,021 B2 * 10/2019 Iwasaki ..... F21S 41/26

(Continued)

FOREIGN PATENT DOCUMENTS

EP 2 020 610 B1 ‡ 4/2011
EP 2020610 B1 4/2011

(Continued)

*Primary Examiner* — Anne M Hines

(74) *Attorney, Agent, or Firm* — Valeo North America, Inc.

(57) ABSTRACT

The present invention discloses an optical device for a motor vehicle comprising: a light guide; at least one collimator; at least one light source associated with each collimator; and at least one optical coupler having at least two reflecting facets. The optical coupler couples a collimator with the light guide at the light entry face of the light guide. The collimator is adapted to receive the light beam emitted by a light source and to collimate this beam; and directing the collimated beam towards the reflecting facets of the optical coupler. At least part of collimated light beam from the reflecting facets enters the light guide and directed towards the light exit face along an optical axis of the light guide. The optical device further comprises at least one aperture for diverting other part of the collimated light beam out of the light guide.

12 Claims, 3 Drawing Sheets

(56) References Cited

U.S. PATENT DOCUMENTS

| | | | | |
|---|---|---|---|---|
| 2005/0286262 | A1‡ | 12/2005 | Gasquet ..... | F21S 43/249<br>362/55 |
| 2009/0262546 | A1‡ | 10/2009 | Stefanov ..... | F21S 41/143<br>362/50 |

FOREIGN PATENT DOCUMENTS

| | | | |
|---|---|---|---|
| EP | 3 205 926 | A1 ‡ | 8/2017 |
| EP | 3205926 | A1 | 8/2017 |

* cited by examiner
‡ imported from a related application 40
40a
40b
40c 5
20
10
15
30
25
30a
30b
30c
30d
30e
15
40
OA
X
Y
Z

OPTICAL DEVICE FOR A LIGHTING AND/OR SIGNALLING DEVICE OF AN AUTOMOBILE VEHICLE

CROSS-REFERENCE TO RELATED APPLICATIONS

This application is a continuation of U.S. application Ser. No. 16/447,396 filed Jun. 20, 2019, the entire contents of which are incorporated herein by reference.

FIELD OF THE INVENTION

The present invention relates to lighting and/or signaling device for automobiles, and more particularly, to a light guide unit of the lighting and/or signaling device for automobiles.

BACKGROUND

Efforts to improve the lighting efficiency and uniformity, particularly for park, turn, signal, running and signature lamps, which are frequently integrated around headlamps and tail lamps, are an on-going endeavor among Original Equipment Manufacturers (OEM) and the numerous component/system suppliers. Of particular interest is the desire to propagate the light as uniformly as possible. The present invention is directed one such innovation solution to provide a lighting and/or signaling device which can produce efficient and uniform light beam.

Lighting devices, particularly for vehicles, have many stringent requirements, particularly concerning lighting efficiency and uniformity, particularly for park, turn, signal, running and signature lamps. These lighting devices includes a light guide to provide different lighting and/or signaling functions.

Conventional light guiding devices have a relatively simple structure, but the uniformity of light diffusion is somewhat restricted. In particular, in applications involving multiple light sources (LEDs), the uniformity of the light that has passed through the light guiding device is often unsatisfactory. In some conventional light guiding devices, optical couplers are used to couple the light guide and a collimator. Further, the light sources are positioned in such a way that the direction of emission of the LEDs is perpendicular to an optical axis of the headlamp. Majority of the light rays propagate from a light entry side of the light guide to the light exit side of the light guide by the principal of total internal refection. Because of the design of the optical couplers, some of the light rays may reach to the light exit side of the light guide without undergoing any diversion and/or reflections, thus causing high luminous intensity points, also called hotspots. An observer when viewed from a side of the vehicle may perceive these hotspots. To this observer, the light guide has a look out along its length with brighter points appearing at the location of the optical couplers. The hotspots produce an unaesthetic effect that disturbs the homogeneity of the emitted light beam. The invention herein overcomes one or more of the problems of the known light guiding devices.

SUMMARY OF THE INVENTION

The present invention is directed to a unique solution to one or more of the problems discussed above. It is believed that that the present invention provides a lighting and/or signaling device that can produce efficient and uniform light beam. In particular, the present invention provides an optical device for vehicles having a light guide with one or more apertures, also called as air prisms, which are adapted to direct the light rays causing hotspots to out of the light guide to produce efficient and uniform light beam.

Accordingly, pursuant to a first aspect of the present invention, there is contemplated an optical device for a motor vehicle, the optical device comprising: a light guide having a light entry face and a light exit face disposed opposite to the light entry face; at least one collimator; at least one light source associated with each collimator; at least one optical coupler having at least two reflecting facets, wherein a optical coupler is configured to couple a collimator with the light guide at the light entry face of the light guide; wherein said collimator adapted to receive the light beam emitted by a light source and to collimate this beam, and directing the collimated light beam towards the two reflecting facets of the optical coupler, wherein at least part of collimated light beam from the reflecting facets enters the light guide and directed towards the light exit face along an optical axis of the light guide; and at least one aperture for diverting other part of the collimated light beam out of the light guide, wherein said at least one aperture is produced in the thickness of the light guide and situated at the light entry face of the light guide.

The invention may be further characterized by one or any combination of the features described herein, such as the light guide comprises an upper face and a bottom face that are parallel and interconnected by the light exit face; the at least one aperture is provided for each optical coupler and situated closer to a reflecting facet that is facing towards the light entry side of the light guide; the at least one light source is positioned on a Printed Circuit Board (PCB) and a direction of the light emitted from the at least one light source is substantially orthogonal to a longitudinal axis of the light guide; the at least one light source is a Light Emitting Diode (LED); the at least part of the reflected light beam that is directed from the light entry face to the light exit face is in the form of a beam of parallel rays; the at least one aperture is situated in a path of the other part of the reflected light beam; the at least one aperture has a cross section in a shape of a triangle; the at least one aperture has a cross section in a shape of a right-angled triangle: the light guide, at least one collimator and the at least one optical coupler are comprised of a single polymeric piece; the optical device functions for providing lighting, signalling, or both for the motor vehicle.

Accordingly, pursuant to a second aspect of the present invention, there is contemplated a lighting and/or signaling device for a motor vehicle, the lighting and/or signaling device comprising: a reflector assembly; a lens; a housing; and an optical device, wherein the optical device comprises: a light guide having a light entry face and a light exit face disposed opposite to the light entry face; at least one collimator; at least one light source associated with each collimator; at least one optical coupler having at least two reflecting facets, wherein a optical coupler is configured to couple a collimator with the light guide at the light entry face of the light guide; wherein said collimator adapted to receive the light beam emitted by a light source and to collimate this beam, and directing the collimated light beam towards the two reflecting facets of the optical coupler, wherein at least part of collimated light beam from the reflecting facets enters the light guide and directed towards the light exit face along an optical axis of the light guide; and at least one aperture for diverting other part of the collimated light beam out of the light guide, wherein said at least one aperture is produced in the thickness of the light guide and situated at the light entry face of the light guide.

It should be appreciated that the above referenced aspects and examples are non-limiting, as others exist within the present invention, as shown and described herein.

DETAILED DESCRIPTION OF THE PREFERRED EMBODIMENTS

The present invention relates to a lighting and/or signaling device that can produce efficient and uniform light beam. In particular, the present invention provides an optical device having a light guide with one or more apertures, also called as air prisms, which are adapted to direct unwanted light rays or parasitic light rays that are causing high intensity hotspots to out of the optical device, to produce efficient and uniform light beam.

The term "optical axis" is used herein to refer to an imaginary line or plane that defines a path along or proximate which light propagates.

Unless defined otherwise, all technical and scientific terms used herein have the same meaning as commonly understood by one of ordinary skill in the art to which this technology belongs.

Figures 1A, 1B:
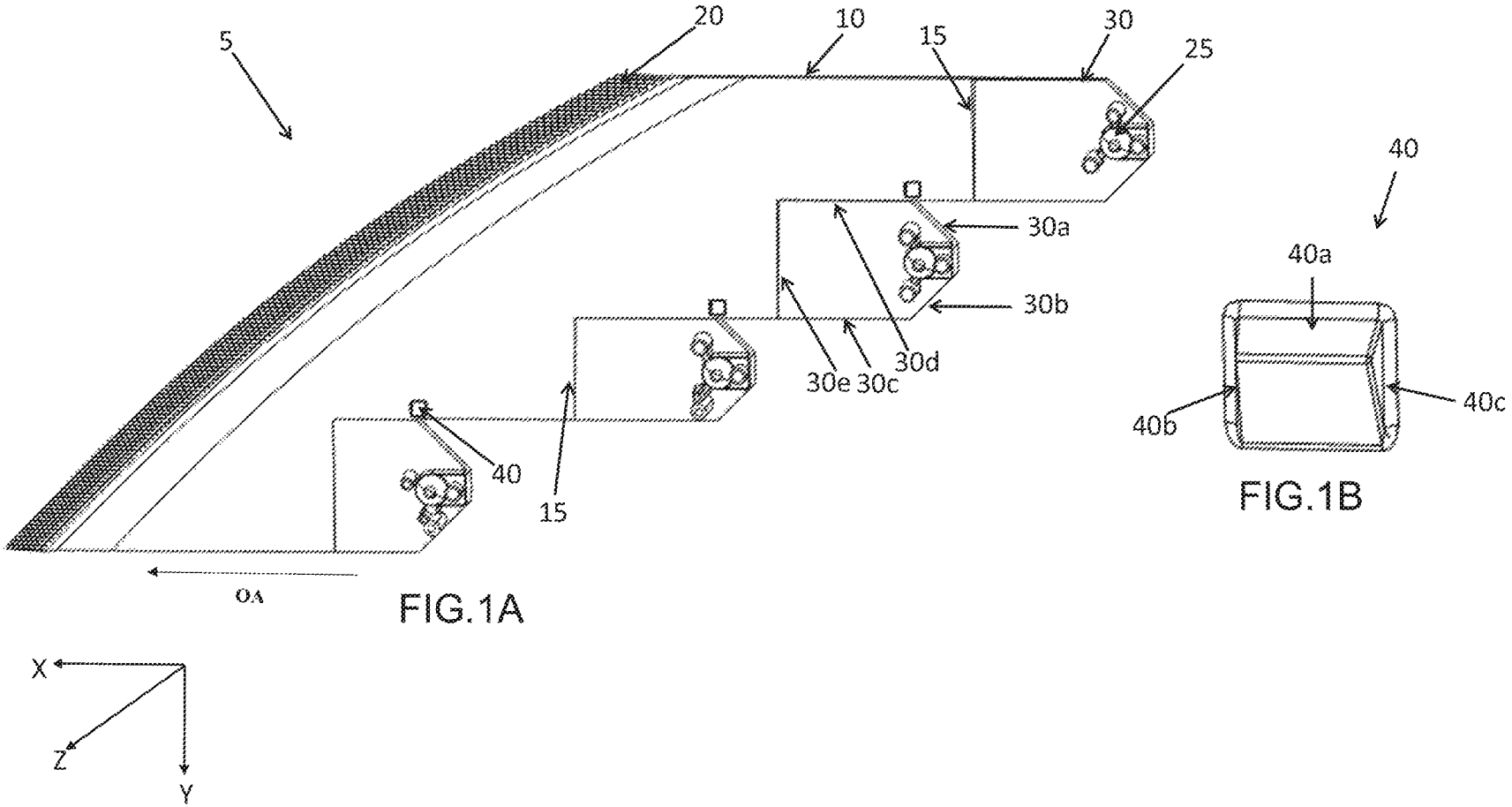
FIG. 1A shows a perspective view of an optical device for a motor vehicle, according to the present invention.
FIG. 1B shows an exploded view of an aperture of the optical device shown in the FIG. 1A, according to the present invention.
Figure 2B:
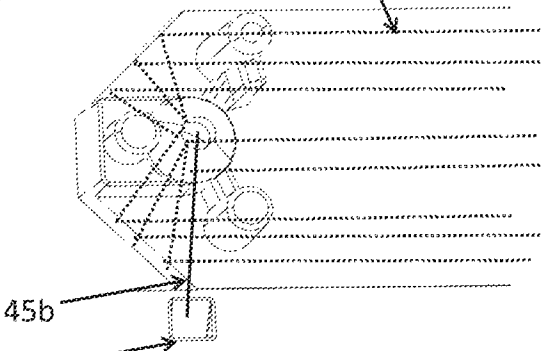
FIG. 2B shows an exploded view of a portion of the optical device shown in the FIG. 2A.
Figure 2A:
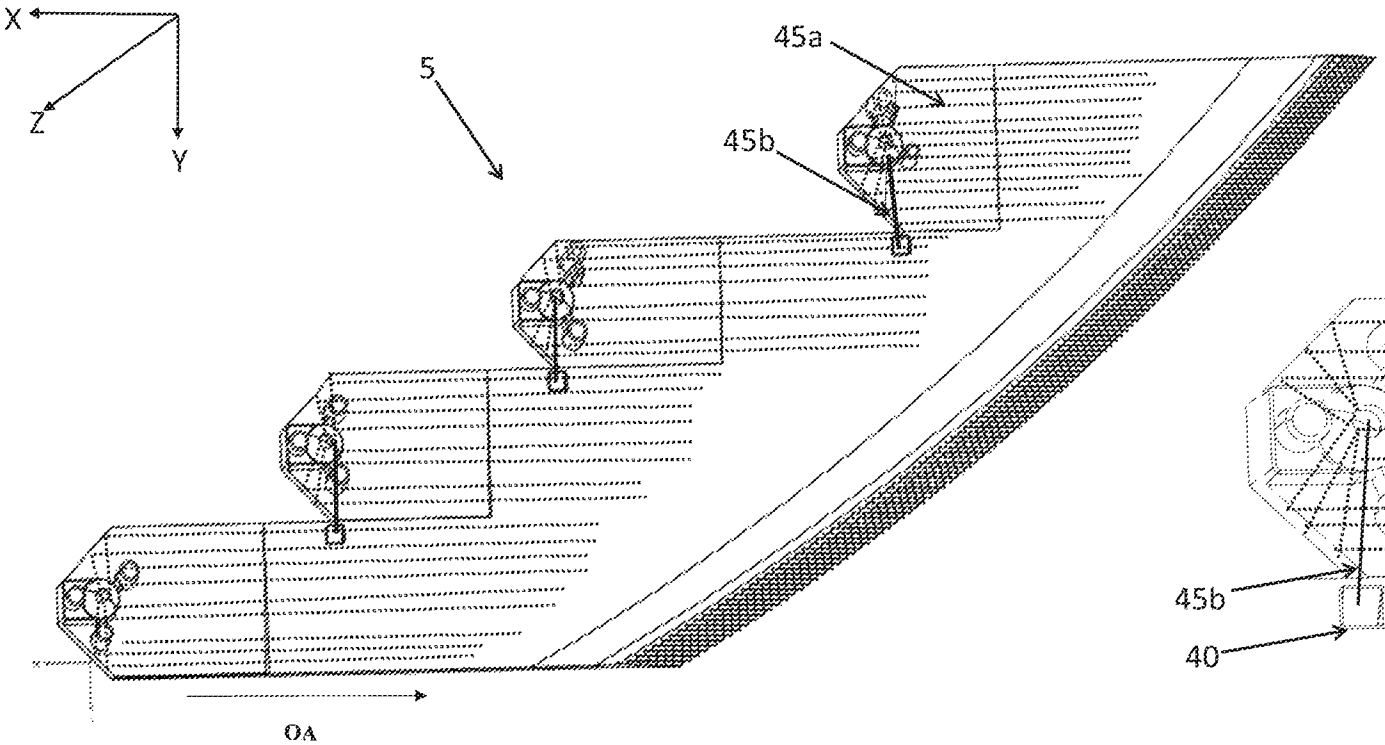
FIG. 2A shows an optical device with light rays that are produced during the operation of the optical device, according to the present invention.
Figure 3:
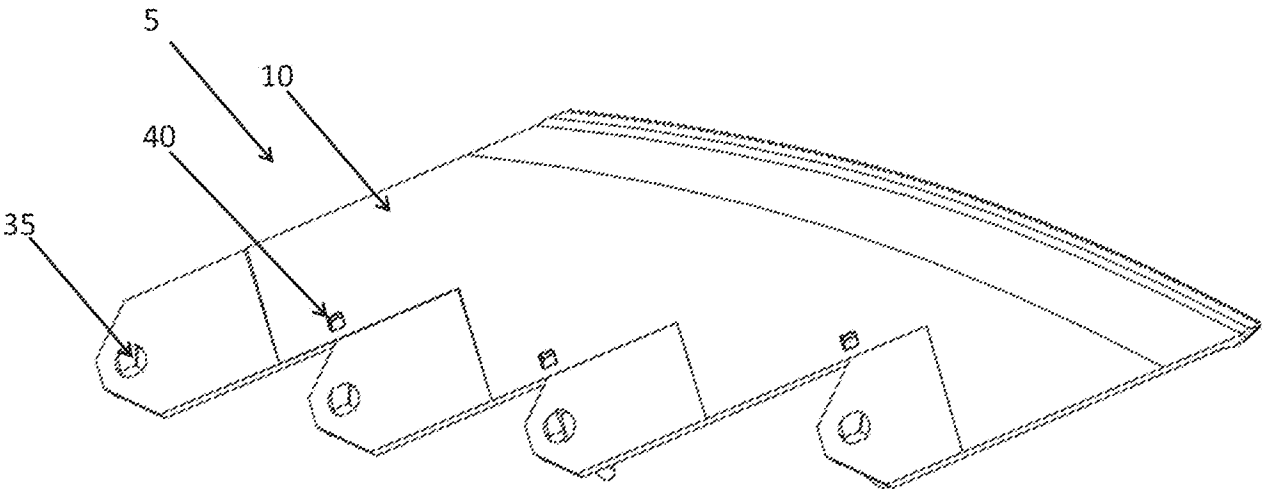
FIG. 3 shows a backside view of an optical device shown in the FIG. 1A, according to the present invention according to the present invention.

The present invention is illustrated in a number of exemplary embodiments, as shown in the FIG. 1A to FIG. 3. Of these, FIG. 1A shows a perspective view of an optical device for a motor vehicle, according to the present invention. FIG. 1B shows an exploded view of an aperture of the optical device shown in the FIG. 1A, according to the present invention. FIG. 2A shows an optical device with light rays that are produced during the operation of the optical device, according to the present invention. FIG. 2B shows an exploded view of a portion of the optical device shown in the FIG. 2A. FIG. 3 shows a backside view of an optical device shown in the FIG. 1, according to the present invention.

FIG. 1A to FIG. 3 illustrates an embodiment of a lighting and/or signaling device for vehicles, in particular to automobiles, according to the present invention. It is understood that the invention is also applicable to lighting devices or even to lighting and signaling devices for such vehicles.

For the following description, it will be appreciated that optical module 5 surfaces define an XYZ orthogonal coordinate system with X, Y and Z corresponds to height axis of the optical device according to Y, with the length axis of said optical device according to X axis and width of the optical device according to Z.

As shown in the FIG. 1A, an optical device 5 for a motor vehicle comprising: a light guide 10 having a light entry face 15, a light exit face 20 disposed opposite to the light entry face 15, and a transmitting section 25, which is intermediate between the light entry face 15 and the light exit face 20; at least one collimator 25; and at least one light source (not shown in the Figures) associated with each collimator 25.

According to an embodiment of the present invention, the light guide 10 is preferably made of a transparent plastic, by means of injection molding. The light guide 10 may be curved, following the curved geometry of headlight of vehicles. In other embodiments, the light guide 10 may be differently curved. However, the present invention is not limited to the curved light guides, but also extends to rectilinear light guides. The light entry face 15 and the light exit face 20 are substantially parallel to one another, so that the light guide 10 has a constant thickness. The light guide 10 is configured such that the received light is guided from the light entry face 15 to the light exit face 20 along an optical axis OA, in other words along the X axis.

As shown in the FIG. 1A and the FIG. 2A, the optical device comprises multitude of optical couplers 30, which are positioned at the light entry face 15 of the light guide 10. It will therefore be understood that the couplers are associated with light entry faces 15 of the light guide 10. Here, in the FIG. 2A and the FIG. 2B, four optical couplers are shown. It will be understood that the number of optical couplers are not limited to four and notably depends on the dimensions of the light guide 10. Each optical coupler 30 generally comprises several reflection facets, for example, two reflection facets 30*a*, 30*b*, as shown in the FIG. 1A and the FIG. 2A. Each optical coupler 30 further comprises two sidewalls 30*c*, 30*d* extending from the reflection facets 30*a*, 30*b*, and a contact surface 30*e* that is in contact with the light entry face 15 of the light guide 10 and with the sidewalls 30*c*, 30*d*. The optical coupler 30 is configured to couple the light guide 10 with a collimator 25 at the light entry face 15 of the light guide 10.

In an embodiment, the thickness of the optical couplers 30 is same as the thickness of the light guide 10.

As can be seen from the FIG. 1A and the FIG. 2A, a collimator 25 is associated with each optical coupler 30. The collimator 25 and the optical coupler 30 can be in contact. The collimator 25 may include a lens, a reflector, a refractor (not shown in the Figures), or any other means of collimation concave or convex type. The collimator 25 has a bottom face entrance 35 (shown in the FIG. 3), which is the light entry side adapted to receive light emitted by a light source when the light source is disposed at the bottom face entrance 35 of the collimator 25. A light source (not shown in the Figures) is associated with each collimator 25 and the light source is disposed in such a way that the light beam emitted by the light source is substantially orthogonal to the optical axis OA of the optical device 5, in other words the light source emit the light beam in Y direction. The light source comprises one or more light emitting diodes located in the same plane, for example arranged on a printed circuit board (PCB) located below the optical device. i.e. the light source is arranged in such a way that the light source faces the bottom face entrance 35 of the collimator 25.

In an embodiment, the collimator 25 is adapted to receive the light beam emitted by the associated light source and collimates the emitted light beam. The collimated light beam is then directed toward the reflection facets 30*a*, 30*b* of the optical coupler 30.

As illustrated in the FIG. 1A and the FIG. 2A, the optical device 5 further comprises at least one aperture 40 produced in the thickness of the light guide 10 and situated at the light entry face 15 of the light guide 10. In particular, the at least one aperture 40 is situated closer to a sidewall 30*d* of the optical coupler 30 that is in contact with the light entry face 15 of the light guide 10. As evident from the FIG. 1A and the FIG. 2A, the at least one aperture 40 is produced for each optical coupler 30. Although the figures illustrate a single aperture at each optical coupler 30, it is understood to a person skilled in the art that there may be more than a single aperture associated with each optical coupler 30.

In an embodiment, the at least one aperture 40 has a cross section in a shape of a triangle. The at least one aperture 40 includes a rectangular side 40*a* and two triangular sides 40*b* and 40*c*, as shown in the FIG. 1B. In another embodiment, the at least one aperture 40 has a cross section in a shape of a right-angled triangle. The at least one aperture 40 is configured to change the orientation of the unwanted light rays propagating in the light guide 10. It is understood to a person skilled in the art that the shape of the at least one aperture 40 can be of any shape that can change the orientation of the unwanted light rays propagating in the light guide 10. The unwanted light rays are the light rays that are cause of hotspots.

The path of the light within the optical device 5 will now be described with respect to the FIG. 2A and the FIG. 2B. In operation, the light rays or the light beam emitted by the light sources are collimated by the collimators 25 to generate collimated light beams. The collimated light beams are then transmitted towards the reflection facets 30*a* and 30*b* of the optical coupler 30, where the reflection facets 30*a*, 30*b* reflect the collimated beams. These facets 30*a* and 30*b* are configured to direct the beams following a direction substantially parallel to the optical axis OA of the optical device, in other words in the X direction. At least a portion of the collimated light beam from the reflecting facets 30*a* and 30*b* enter the light guide 10 via the light entry face 15 and directed toward the light exit face 20 along the optical axis OA of the light guide 10. The path of the portion of the light that is directed toward the light exit face is shown in general manner by the reference 45*a*, in the FIG. 2A and the FIG. 2B. Other portion of the collimated light beam is directed out of the light guide via the at least one aperture 45, and the path of the other portion of the light beam that is directed out of the light guide is shown in general manner by the reference 45*b* in the FIG. 2A and the FIG. 2B. In particular, other portion 45*b* of the collimated light beam is directed towards the rectangular side 40*a* of the aperture 40, which changes the orientation of the beam and directs it to out of the light guide 10. Further, the portion 45*a* of the light beam that is being directed towards the light exit face passes through the traingular sides 40*b* and 40*c* of the aperture 40 and therefore the orientation of this portion of the beam remains same. Thus, the unwanted light rays 45*b* or the parasitic light rays are directed out of the light guide 10 through the apertures 40 and thereby high luminous intensity points that are formed with the conventional optical devices are now eliminated. Therefore, the continuous light beam is emitted from the light exit face 20 of the light guide 10.

On the FIG. 3 showing backside view of the optical device 5 shown in the FIG. 1A and the FIG. 2A. As previously mentioned, the portion 45*b* of the collimated light beams that are directed toward the rectangular side 40*a* of the aperture 40 are sent out of the light guide 10.

In an embodiment, the optical device 5 is monolithic, in other words, formed from a single piece, for example by molding of plastic material, i.e., the light guide, at least one collimator and the at least one optical coupler are comprised of a single polymeric piece.

As shown in the foregoing, the optical device 5 of the present invention provides more efficient and uniform light beam.

In an embodiment, the optical device functions for providing lighting for the motor vehicle. In another embodiment, the optical device functions for providing signaling for the motor vehicle. Yet, in another embodiment, the optical device functions for providing both lighting and signaling for the motor vehicle.

Although the present disclosure is provided with reference to figures, all of the embodiments shown in figures are intended to explain the preferred embodiments of the present invention by ways of examples, instead of being intended to limit the present invention.

Apparently, it would be appreciated by those skilled in the art that various changes or modifications may be made in the present disclosure without departing from the principles and spirit of the disclosure, which are intended to be covered by the present invention as long as these changes or modifications fall within the scope defined in the claims and their equivalents.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes.

The term "consisting essentially" of to describe a combination shall include the elements, ingredients, components or steps identified, and such other elements ingredients, components or steps that do not materially affect the basic and novel characteristics of the combination.

The invention claimed is:

1. An optical device of a motor vehicle comprising:

a light guide having a light entry face and an opposing light exit face located relative to the light entry face;

at least one collimator;

at least one light source associated with each collimator;

at least one optical coupler having at least two reflecting facets, wherein the respective optical coupler is configured to couple the respective collimator with the light guide at the light guide's entry face;

wherein each respective collimator is adapted to receive an associated light by the respective light source to form a collimated beam, and direct the collimated beam towards the at least two reflecting facets of the respective optical coupler, wherein a portion of the collimated beam from the at least two reflecting facets enters the light guide and is directed towards the opposing light exit face along an optical axis of the light guide; and wherein another part of the collimated beam is diverted out of the light guide by at least one aperture that resides within a thickness of the light guide and where each aperture is situated along the light entry face of the light guide.

2. The optical device of claim 1, wherein the light guide comprises an upper face and a bottom face that are parallel and interconnected by the light exit face.

3. The optical device of claim 1, wherein the at least one aperture is provided for each optical coupler and where each aperture is situated closer to a reflecting facet that is facing towards the light entry side of the light guide.

4. The optical device of claim 1, wherein the at least one light source is positioned on a Printed Circuit Board (PCB) and a direction of the light emitted from the at least one light source is directed substantially orthogonal to a longitudinal axis of the light guide.

5. The optical device of claim 1, wherein the at least one light source type is a Light Emitting Diode (LED).

6. The optical device of claim 1, wherein the portion of the collimated beam that is directed from the light entry face to the light exit face is in the form of a beam collection of parallel light rays.

7. The optical device of claim 1, wherein the at least one aperture is situated in a path of an other part of the reflected light beam.

8. The optical device of claim 1, wherein the at least one aperture has a cross-section in a shape of a triangle.

9. The optical device of claim 1, wherein the at least one aperture has a cross-section in a shape of a right-angled triangle.

10. The optical device of claim 1, wherein the light guide, at least one collimator and the at least one optical coupler are formed from a single polymeric piece of material.

11. The optical device of claim 1, wherein the optical device is configured to provide a lighting function, a signaling function or both functions for the motor vehicle.

12. A lighting or signaling device of a motor vehicle comprising:

a reflector assembly; a lens; a housing; and an optical device, where the optical device comprises:

a light guide having a light entry face and an opposing light exit face located relative to the light entry face;

at least one collimator;

at least one light source associated with each collimator;

at least one optical coupler having at least two reflecting facets, wherein the respective optical coupler is configured to couple the respective collimator with the light guide near the light entry face of the light guide;

wherein each respective collimator is adapted to receive an associated light emitted by the respective light source and to form a collimated beam, and direct the collimated beam towards the at least two reflecting facets of the respective optical coupler, wherein a portion of the collimated beam from the at least two reflecting facets enters the light guide and is directed towards the opposing light exit face along an optical axis of the light guide; and wherein another part of the collimated beam is diverted out of the light guide by at least one aperture that resides within a thickness of the light guide where each aperture is situated along the light entry face of the light guide.

* * * * *